United States Patent [19]

Lebrecht

[11] 4,180,996

[45] Jan. 1, 1980

[54] PADLOCK CYLINDER RETAINER BLOCK SECURING MEANS

[75] Inventor: Horst Lebrecht, Cedarburg, Wis.

[73] Assignee: Master Lock Company, Milwaukee, Wis.

[21] Appl. No.: 916,877

[22] Filed: Jun. 19, 1978

[51] Int. Cl.[2] ..... E05B 67/02

[52] U.S. Cl. ..... 70/52; 70/417

[58] Field of Search ..... 70/417, 52, 51, 54, 70/373

[56] References Cited

U.S. PATENT DOCUMENTS

| | | | |
|---|---|---|---|
| 2,015,248 | 9/1935 | Williams | 70/417 |
| 3,835,676 | 9/1974 | Foote | 70/52 |
| 3,979,931 | 9/1976 | Man | 70/38 A |

FOREIGN PATENT DOCUMENTS

| | | | |
|---|---|---|---|
| 1279 | of 1806 | United Kingdom | 70/52 |

*Primary Examiner*—Robert L. Wolfe

*Attorney, Agent, or Firm*—Curtis B. Morsell, Sr.

[57] ABSTRACT

In a certain form of key-operated padlock of generally curved contour with a flat bottom there is accessible from the bottom of the padlock body a generally rectangular crevice outlining the cavity in the body block which flushly receives the retainer block and cylinder. In the present invention the padlock body and the enclosed retainer block have mating and cooperating eccentrically shaped ribs and grooves which are effective in preventing unauthorized attempts at a tool insertion in the crevice surrounding the exposed end portion of the block sufficient to separate portions of the block and the enclosing padlock body, or to break out wall portions of the latter. Additionally, unauthorized disengagement of the retainer block from the padlock body is prevented by a pair of hardened pins which extend from the padlock body into the retainer block and are rotatably mounted in the latter.

8 Claims, 6 Drawing Figures

PADLOCK CYLINDER RETAINER BLOCK SECURING MEANS

BACKGROUND OF THE INVENTION AND SUMMARY THEREOF

A general subject of the invention is to provide in a cylinder retainer block equipped padlock, simple but effective means for preventing surrepticious dismemberment of wall portions of the padlock body or block, or disengagement of the block from the padlock cylinder.

Further objects of the invention are to provide in a curved body padlock co-acting retainer means between the body and the block with which said lock components may be readily fashioned during manufacture, which function automatically, which are strong and durable and do not affect the appearance of the padlock, and which are effective for the intended purpose.

Description of the Prior Art

All of the prior patents relating to certain types of padlocks having retainer block-housed cylinders are devoid of any special types of means for preventing unauthorized tool insertion in the crevices surrounding the perimeters of the retainer block to deter component separation or wall breakage of the lock body, and further lack "anti-saw" pins extending from portions of the padlock body into portions of the retainer block.

BRIEF DESCRIPTION OF THE DRAWING

In the accompanying drawing wherein the same reference characters indicate the same parts in all of the views.

DESCRIPTION OF THE PREFERRED EMBODIMENT

Figure 1:
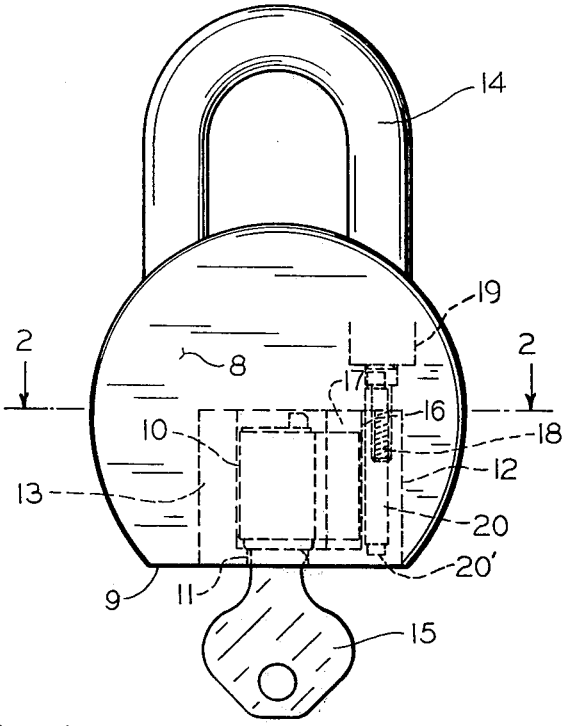
FIG. 1 is a front elevational view of a key operated padlock of generally curved contour wherein a cavity in the body contains a cylinder enclosed by a retainer block with the block and padlock body being formed with the improved, mating securing means and being joined by the "anti-saw" pins.

A typical key-operated, curved contour padlock which incorporates the present cylinder retainer block dual securing means is shown in FIG. 1 of the drawing. For the purposes of this application it will only be necessary to describe those portions of the padlock which are directly responsible for the present improvements.

This padlock, of course, includes the usual body or case 8 which is of generally curved contour with a flat open bottom 9 which allows access to the lower end of the housed internal cylinder 10 having a key slot 11 therein. There is a cavity 12 of a substantial size within the lower portion end of the housed internal cylinder 10 having a key slot 11 therein. There is a cavity 12 of a substantial size within the lower portion of the body 8, opening through the lower flat bottom 9 of the body, which cavity compactly houses a cylinder retainer block 13 in which the cylinder is operatively housed. The body 8 has projecting from its upper end a shackle 14. The shackle, when the padlock is unlocked by a turning movement of a key 15 inserted into the cylinder key slot 11, is projected from the closed position of FIG. 1 to an open position by the usual spring means. It should be understood that when the inserted key 15 is operated to properly turn the cylinder 10, the usual internal mechanism controlled by the cylinder and its extension operates for shackle releasing purposes.

In the past, in padlocks of the type under consideration devoid of the present improvements, a chisel or tool pounded into the crevice surrounding the cavity 12, from the exposed open bottom 9 of the padlock body 8, by a tamperer, could be effective to break out the narrowed portions of the body walls outwardly of the exposed longitudinal margins of the retainer block 13 thereby impairing the padlock and rendering it incapable of performing its protective functions. Conceivably, the cylinder 10 might also be pried out of the block 13 to give the tamperer access to the shackle operating mechanism for unauthorized operation thereof. These possibilities are eliminated by the improved securing means which will now be described.

Figure 2:
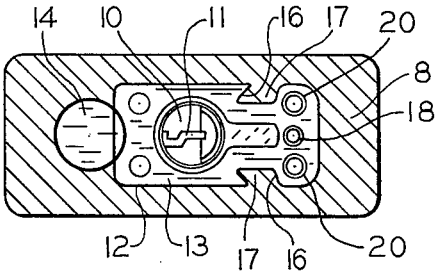
FIG. 2 is a transverse sectional view taken on line 2—2 of FIG. 1, only with the key omitted.
Figure 3:
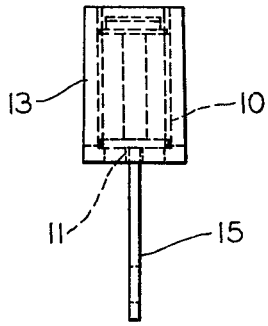
FIG. 3 is an end view of the retainer block unit with a dotted line showing of the enclosed cylinder having an operating key inserted thereinto.
Figure 4:
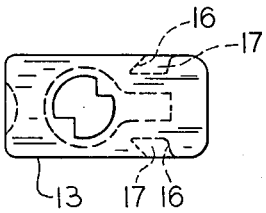
FIG. 4 is a bottom view of the cylinder retainer block.

As is best shown in FIG. 2 opposite sides of the retainer block 13 are formed with eccentrically shaped grooves 16 running the height of said block. These grooves are filled by mating ribs 17 of similar eccentric shape which extend inwardly from wall portions of the lock body adjacent the cavity 12. The aforesaid cooperating grooves 16 and ribs 17 on or in the members 8 and 13 respectively, provide effective means for deterring or preventing surrepticious tool applied attempts to dismember wall portions of the padlock body 8 and/or separation therefrom of the cylinder retainer block 13.

Figure 5:
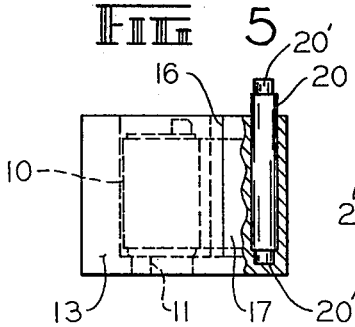
FIG. 5 is a side view of the cylinder retainer block with a portion broken away and in section to show one of the "anti-saw" pins between the body and the retainer block.
Figure 6:
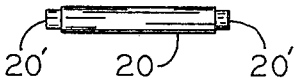
FIG. 6 is a detailed side view of one of said pins.

In addition to the mating grooves and ribs 16 & 17 above described the retainer block securing means include a pair of pins 20, best shown in FIGS. 5 & 6. Said pins extend downwardly from openings therefore in the padlock body 8 into suitable bores therefore in the retainer block 13. Said pins are of a hardened metal resistant to the application of a sawing tool thereto and their opposite extremities are reduced, as at 20', which will negative unauthorized attempts to remove said pins by drilling holes into the base of the block 13. The reduced ends 20' would engage an applied drill point and prevent the drilling of holes of sufficient diameter to permit illicit removal of said pins 20. Also, said pins are mounted so as to rotate in the bores which receive them in the block 13. If an attempt were made to saw through the padlock body and engage said pins, the pins would rotate, but being hardened, the applied saw would not cut therethrough.

Below the lower end of the socket 19 in the padlock body for the short, swingable leg of the shackle 14, there is a screw 18 extending into the block 13 between the pins 20. This screw is effective in holding the retainer block 13 securely within the lock body.

From the foregoing description it will be evident that the improved padlock cylinder retainer block securing means are simple and effective and are generally well adapted for their intended purposes.

What is claimed is:

1. In a key controlled padlock having a body of generally curved contour with an exteriorally opening cavity therein of generally rectangular contour, a cylinder retainer block corresponding to the shape of said body cavity and substantially filling the latter and having wall portions closely adjacent wall portions of said body, there being a generally rectangular crevice outlining said cavity outwardly of the adjacent wall portions of the lock body and retainer block, a cylinder operatively housed within said retainer block and having a key slot therein, said crevice and said key slot being accessible through the exteriorally opening portion of the body cavity, mating means formed in and on adjacent wall portions of the body and block to prevent separation of the body and block or damage to the body walls should a foreign object be inserted into an exteriorally accessible portion of the body cavity and manipulated therein, said mating means including eccentrically shaped grooves formed in said wall portions of the retainer block and eccentrically shaped ribs formed on said wall portions of said body, the grooves and ribs extending throughout the heights of their respective members, and hardened metal pins extending from portions of the body with portions of said block.

2. In a key controlled lock having a body with an exteriorally opening cavity therein and a cylinder retainer block occupying said body cavity, wall portions of said retainer block being in adjacency to wall portions of said lock body, the improvements which include elongated, eccentrically shaped groves formed in wall portions of one of said members filled by similarly shaped ribs on said wall portions of the other of said members providing means for deterring unauthorized separation of one of said members from the other.

3. The lock recited in claim 2 wherein wall portions of the retainer block contain said grooves, and adjacent wall portions of the lock body contain said mating ribs.

4. The lock recited in claim 2 wherein there are other connections between the lock body and the retainer block.

5. The lock recited in claim 4 wherein said other connections between the lock body and the retainer block include hardened metal pins extending from portions of the body into portions of said block.

6. The lock recited in claim 5 wherein said pins have reduced diameter extremities.

7. The lock recited in claim 5 wherein said pins are spaced apart and there is interposed therebetween a screw extending from a portion of the body with the block.

8. The lock recited in claim 5 wherein said pins are rotatable within the portions of the body into which they extend.

* * * * *